US005291679A

United States Patent [19]

Wollack et al.

[11] Patent Number: 5,291,679

[45] Date of Patent: Mar. 8, 1994

[54] MAGAZINE WITH INDICATOR

[75] Inventors: Timothy A. Wollack, Maryville, Tenn.; John L. Wollack, Kula, Hi.

[73] Assignees: E. M. Kelman; E. M. Kelman, Maryville, Tenn.; J. L. Wollack; J. E. Wollack, Kula, Hi.

[21] Appl. No.: 898,499

[22] Filed: Jun. 15, 1992

[51] Int. Cl.[5] ..... F41A 9/62

[52] U.S. Cl. ..... 42/50

[58] Field of Search ..... 42/1.01, 1.02, 6, 7, 42/49.01, 50, 90

[56] References Cited

U.S. PATENT DOCUMENTS

| | | | |
|---|---|---|---|
| 343,471 | 6/1886 | Maynard | 42/1.02 |
| 382,455 | 5/1888 | Butler | 42/1.02 |
| 387,531 | 8/1888 | Miller | 42/49.01 |
| 502,389 | 8/1893 | Whitten et al. | 42/1.02 |
| 784,786 | 3/1905 | Gottardi | 42/1.02 |
| 1,202,768 | 10/1916 | Arnold | 42/1.02 |
| 1,326,234 | 12/1919 | Veeder | 42/1.02 |
| 1,332,936 | 3/1920 | Veeder | 41/1.02 |
| 2,377,661 | 6/1945 | Baker et al. | 42/1.02 |
| 2,569,995 | 10/1951 | Kapsa | 42/1.02 |
| 2,620,582 | 12/1952 | Stukas | 42/1.02 |
| 2,828,568 | 4/1958 | Sakewitz | 42/1.02 |
| 4,558,626 | 12/1985 | Bartolles | 42/1.02 |
| 4,587,756 | 5/1986 | Jakubaschk et al. | 42/1.02 |
| 4,688,344 | 8/1987 | Kim | 42/50 |
| 4,845,874 | 7/1989 | Etheridge et al. | 42/90 |

FOREIGN PATENT DOCUMENTS

| | | | |
|---|---|---|---|
| 1278287 | 9/1968 | Fed. Rep. of Germany | 42/1.02 |

*Primary Examiner*—Stephen C. Bentley
*Attorney, Agent, or Firm*—Martin E. Hsia

[57] ABSTRACT

A magazine with an elongated indicator member attached to the follower and projecting outside the body of the magazine so that the length of the indicator member indicates how many bullets remain in the aperture. The indicator member is provided with a series of knots at predetermined intervals so that the number of knots on the portion of the indicator member projecting outside the body of the magazine equals the number of bullets remaining in the magazine. More elaborately, each knot can correspond to a predetermined number of remaining bullets, or the knots can vary in configuration to provide a tactile code of the number of remaining bullets so that the user only needs to feel the knot closest to the magazine to determine the number of bullets remaining.

48 Claims, 3 Drawing Sheets

MAGAZINE WITH INDICATOR

BACKGROUND OF THE INVENTION

This invention relates to magazines for firearms, and specifically to indicators showing the number of bullets remaining in a gun magazine.

Guns are usually constructed to fire a plurality of bullets, often by employing a removable magazine that contains a plurality of bullets (as used herein, "bullets" includes "cartridges"). Typically, a magazine comprises a hollow body configured to accept a plurality of bullets and having a bullet aperture through which bullets are loaded into the magazine and through which bullets are urged to enter the gun's firing chamber. The magazine is usually provided with a follower that is urged towards the bullet aperture, usually by a spring, so that a new bullet is urged towards the bullet aperture after a bullet is removed from the magazine.

It is very desirable to be able to determine the number of bullets in a magazine so that the user knows how many shots he has left. Of course, this can be determined by knowing the capacity of the magazine when full, and counting the number of bullets that have been fired. However, guns are often used in stressful situations, such as in gun battles, and it is therefore very easy to forget the number of rounds that have been fired. In such circumstances, it is also impossible to eject the magazine in order to count the number of bullets remaining. Also, the user might not be able to look at any visual indicator of the number of bullets that may be left in the magazine, either because of the circumstances or because there is not enough available light.

Many patents have been issued relating to indicators for magazines.

U.S. Pat. No. 2,377,661 to Baker discloses a magazine having a flexible ribbon joined to the follower and having an indicator means attached, where the position of the indicator means along a slot informs the user of the number of cartridges within the magazine.

U.S. Pat. No. 1,202,768 to Arnold discloses an indicator tape having indicating characters that are selectively displayed in a frame as ammunition is discharged.

U.S. Pat. No. 382,455 to Butler discloses a bar having gear teeth on an edge and a series of figures intended to be visible one at a time through an opening.

U.S. Pat. No. 3,828,568 to Sakewitz discloses a magazine having a plate marked with numbers that moves past two windows in the grip of a gun to indicate the number of cartridges remaining.

U.S. Pat. No. 2,620,582 to Stukas discloses a magazine having a slot on the side which would show the number of cartridges remaining.

U.S. Pat. No. 4,587,756 to Jakubaschk, et al., discloses a magazine having an indicator that follows a spring as it uncoils.

A number of other patents have been issued for indicator means for guns, including U.S. Pat. No. 343,471 to Maynard, U.S. Pat. No. 502,389 to Whitten, et al., U.S. Pat. No. 784,786 to Gottardi, U.S. Pat. No. 1,326,234 to Veeder, U.S. Pat. No. 1,332,936 to Veeder, U.S. Pat. No. 2,569,995 to Kapsa and U.S. Pat. No. 4,558,626 to Bartolles.

Of the above mentioned references, only U.S. Pat. No. 784,786 to Gottardi provides a means for determining the number of cartridges remaining without looking at the gun. Further, except for U.S. Pat. No. 2,377,661 to Baker, all of the above references require structures in the gun to cooperate with the magazine for the indicator to function. Thus, it would be impossible to provide existing guns with the indicators disclosed in the above references (except for Baker) unless the guns were modified to provide the requisite cooperating structures. This prevents retrofitting existing guns with these indicators by merely providing replacement magazines (except for Baker).

Accordingly, it is an object of this invention to provide an indicator that simply and reliably indicates the number of bullets remaining in a magazine.

It is also an object of this invention to provide such an indicator that can be used quickly, easily and reliably without the user looking at the magazine or the gun.

It is a further object of this invention to provide such an indicator that is self-contained in a magazine and that does not require cooperating structure on the gun so that the indicator can be used on existing guns merely by replacing the magazine.

It is a still further object of this invention to provide such an indicator that can be easily retrofitted to existing magazines.

It is a still further object of this invention to provide such an indicator that is simple and inexpensive to manufacture.

BRIEF SUMMARY OF THE INVENTION

These and other objects are obtained by a magazine that comprises a hollow body having a bullet aperture and an indicator aperture, a follower slidably mounted in the hollow body, and an elongated indicator member attached to the follower, extending through the indicator aperture and projecting outside the body by an indicator length so that displacement of the follower causes a change in the indicator length. Preferably the indicator length is very short if the magazine is empty. The indicator length therefore will correspond to the approximate distance that the follower has been displaced from the bullet aperture, which in turn will correspond to the number of bullets in the magazine. Preferably, also, the indicator member comprises a flexible strand that preferably includes a plurality of knots, knobs, beads, slots, holes or other configurations (all hereinafter collectively referred to as "knots") that can be sensed by touch, spaced along the indicator length at predetermined intervals that are fixed so that when a number of bullets is inserted in the magazine, an equal number of knots projects outside the magazine. Thus, by counting the number of knots, the user can determine the number of bullets remaining in the magazine. The user can count the number of knots by feel, which would allow determining the number of bullets remaining without looking at the gun. In more elaborate embodiments, each knot could correspond to a predetermined number of bullets (such as 2, 3 or 5) or the configurations of the knots could vary and be coded so that a user could determine the number of bullets merely by touching the knot closest to the gun.

The short length of the indicator when the magazine is empty and the flexibility of the material used for the indicator allows for field stripping (i.e., disassembly, cleaning and reassembly in the field) without the need for additional tools or effort. Further, if the indicator aperture is drilled through an internal floor insert in the interior of the magazine and also through a slidably removable base plate at the bottom of the magazine, the indicator prevents accidental dismantling of the magazine because the base plate cannot be slidably removed while the indicator is projecting through the indicator aperture. Optionally, a retaining member can be provided at the end of the indicator and the user can pull on the retaining member to pull the follower downwardly and allow speed loading of the magazine.

Existing guns can be easily retrofitted merely by providing replacement magazines that are equipped with the indicator. Existing magazines can be easily retrofitted merely by forming an indicator aperture in the magazine (or by expanding the existing aperture already formed in some magazines), attaching one end of an indicator member to the follower, and allowing the other end of the indicator member to extend through the indicator aperture.

DESCRIPTION OF A PREFERRED EMBODIMENT

Figure 1:
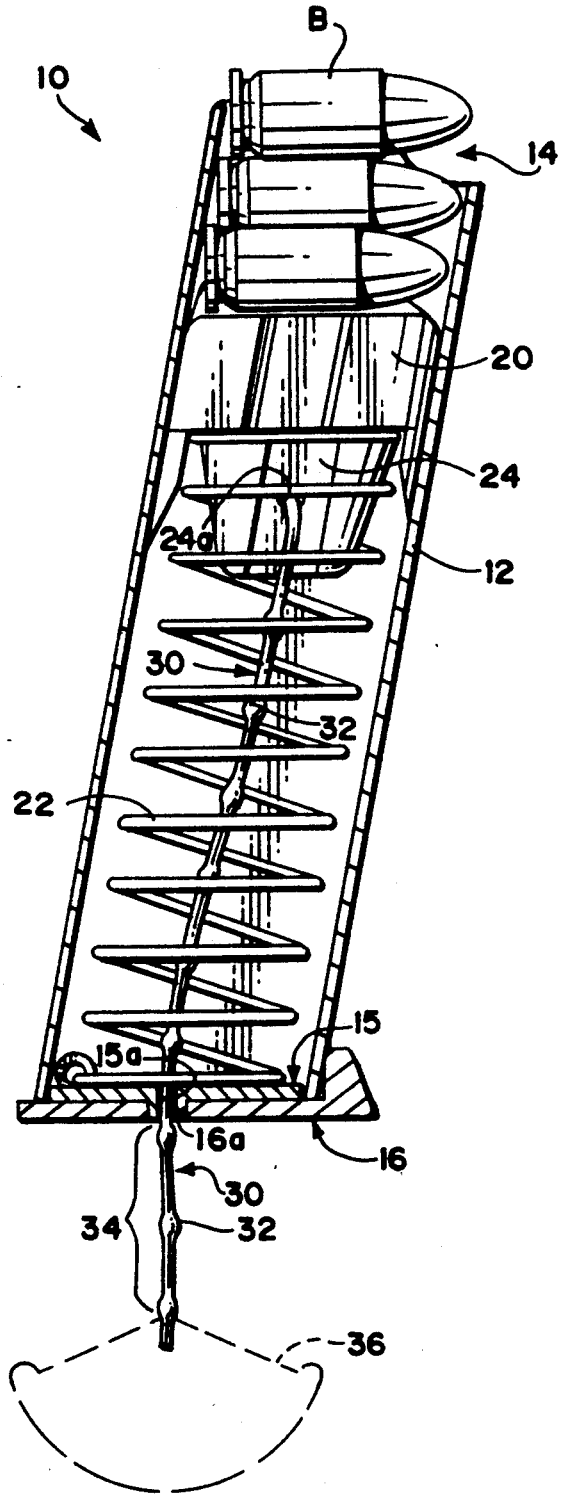
FIG. 1 is a side cut away view of a preferred embodiment of the magazine of the present invention with three bullets in the magazine.
Figure 2:
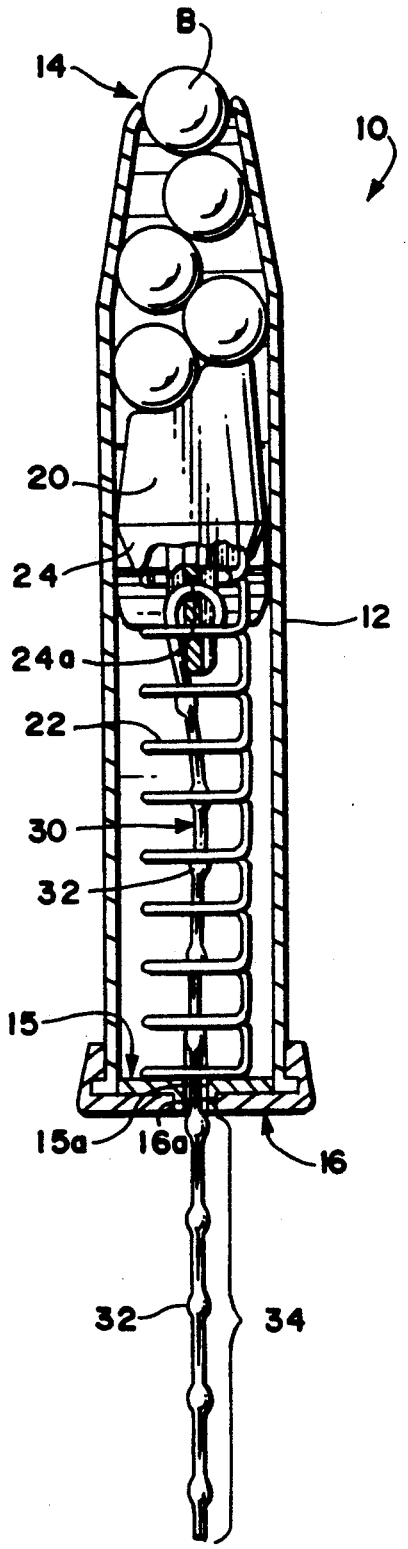
FIG. 2 is a front cut away view of the embodiment of FIG. 1 with five bullets in the magazine.

Referring to FIGS. 1 and 2, a preferred embodiment of the magazine 10 of the present invention comprises a hollow body 12 configured to receive a plurality of bullets B. The hollow body 12 is provided with a bullet aperture 14 through which bullets are loaded into the hollow body 12. An internal floor insert 15 is provided near the bottom of the body 12 and is retained in the body 12 by a base plate 16, which is slidably removable from the bottom of the body 12. The internal floor insert 15 is provided with a first indicator aperture **15*a*, and the base plate is provided with a second indicator aperture 16*a*. A follower 20 is slidably mounted inside the hollow body 12 and is urged towards the bullet aperture 14, preferably by a coil spring 22 disposed between the follower 20 and the internal floor insert 15. An indicator member 30, preferably a strand provided with a series of knots 32, is attached to the bottom of the follower 24 (preferably by drilling a hole 24*a* through the follower and securing the indicator member 30 to the hole 24*a*) and projects through the indicator apertures 15*a* and 16*a* so that an indicator length 34 projects outwardly from the base plate 16**.

Preferably, in the simplest embodiment, the number of knots 32 is equal to the number of bullets that the magazine can hold and the knots 32 are spaced at predetermined intervals so that when a number of bullets B is inserted into the magazine, an equal number of knots 32 projects outside the indicator apertures **15*a* and 16*a*. The intervals therefore would be determined by the pattern of displacement of the follower 20 as bullets B are removed from the body 12. It is also preferred that the series of knots 32 be displaced the appropriate distance from the bottom of the follower 24 so that the number of knots 32 extending outside the magazine 10 is equal to the number of bullets B remaining in the magazine 10**.

For magazines in which the bullets are stacked directly on top of each other, the knots 32 would be spaced at intervals approximately equal to one bullet diameter because the pattern of displacement of the follower 20 as bullets B are removed from the body 12 would be a series of equidistant intervals, with each interval approximately equal to a bullet diameter.

For magazines in which the bullets B are not stacked directly on top of each other, but are laterally offset, as shown in FIG. 2 and as is done in high capacity magazines, the intervals in the pattern of displacement of the follower 20 would be less than the diameter of a bullet B. Further, for magazines in which the offset between vertically abutting bullets varies because the width of the magazine varies, as shown in FIG. 2, the intervals in the pattern of displacement of the follower 20 would not be equal, but would be spaced along the indicator member 30 at varying intervals determined by the displacement of the follower 20 caused by the ejection of each bullet B. For example, the ejection of the last bullet in the magazine 10 would cause the largest displacement of the follower 20 because part of the follower 20 can extend into the bullet aperture 14. However, the ejection of the second to last bullet would cause a smaller displacement because the presence of the last bullet would prevent the follower 20 from projecting into the bullet aperture 14 and because the second to last bullet is offset laterally from the last bullet, so that the displacement would be less than a single bullet diameter. Also, because the top of the magazine 10 is tapered towards the bullet aperture 14, the amount of lateral offset between vertically adjacent bullets will vary depending on the vertical position of the bullets in the magazine 10, which will cause the amount of displacement as bullets are ejected through the bullet aperture 14 to vary depending on the vertical position of the bullets as well.

The above description of the pattern of displacement of the follower 20 as bullets are removed from the body 12 is provided only as an example. Each type of magazine will have a different pattern of displacement of the follower as bullets are removed from the body. Although the necessary spacing of the knots 32 can be determined precisely using mathematical methods and analyses, it is simpler and preferable to determine the spacing empirically simply by attaching the indicator member 30 to the follower 20 and marking the positions for the knots 32 on the indicator length 34 as bullets are ejected from the magazine 10, thus marking the pattern of displacement of the follower 20 as bullets B are removed. The spacing between the knots 32 only needs to be approximate because the use needs only to count the number of knots 32 projecting outside the magazine 10, not to measure the spacing between the knots 32.

In a more elaborate embodiment, each knot could correspond to a predetermined number of bullets remaining in the magazine. For example, each knot could correspond to two, three or five bullets. This embodiment might be preferred if, for example, the user will be wearing gloves or otherwise have less ability to feel the number of knots if they are spaced closely together.

Figure 4:
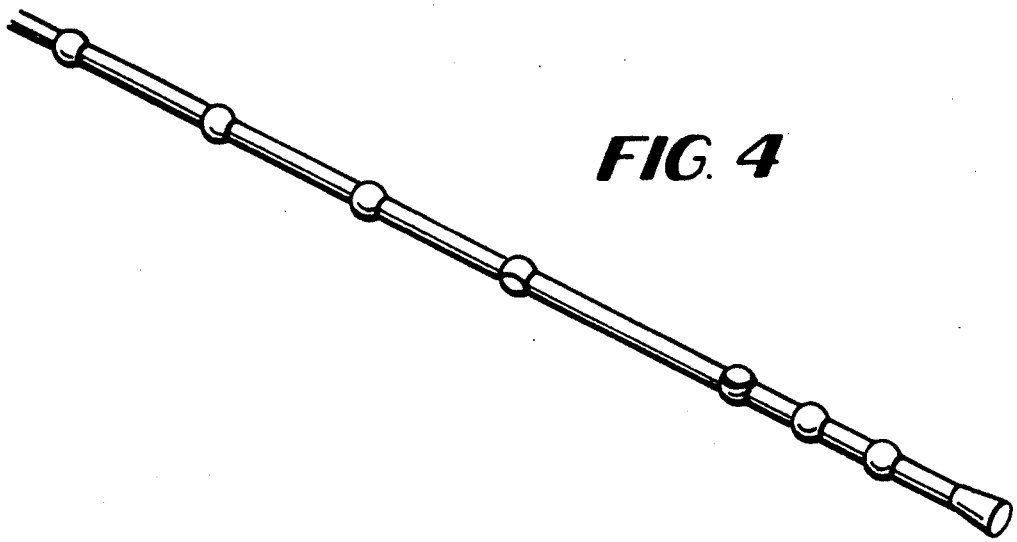
FIG. 4 is a perspective view of still another preferred embodiment of an indicator member according to this invention in which a first plurality of knots has a second plurality of different configurations which provide a tactile code of how many bullets remain in the magazine.

In an even more elaborate embodiment, there would be a first plurality of knots having a second plurality of configurations, and the configurations could be coded to indicate the number of knots remaining, so that the user would not have to count the knots, but could instead determine the number of bullets remaining merely by feeling the knot closest to the gun. For example, as shown in FIG. 4, the knots could be substantially round with a flattened side, and the orientation of the flattened side could vary depending on the number of bullets. Thus, the flattened side on the left could indicate a first number of bullets left, the flattened side facing forward could indicate a second number of bullets left, the flattened side facing to the right could indicate a third number of bullets left, and there could be individual round (unflattened) knots for each of the remaining bullets. For another example, the knots could have a polygonal cross section in a horizontal plane, with the number of sides on the polygon corresponding to a predetermined number of bullets remaining. Of course, the configuration of the knots could be varied by using a number of bumps on the knot, braille or some other tactile code on the knots as well. There are many ways in which the configurations of the knots can be varied to provide a tactile code of how many bullets remain in the magazine, but preferably the tactile code would require feeling only the knot closest to the magazine to determine how many bullets remain. However, the use of coded knots might not be preferred in certain situations, such as where the user will be wearing gloves so that the user would be impaired from tactilely reading the code.

Optionally, a removable grip 36 can be removably attached to the indicator length 34 so the user can pull the follower 20 to abut against the internal floor plate 15 so that bullets B can be loaded into the magazine 10 quickly because they can be loaded without having to overcome the bias of the coil spring 22. This is called "speed loading."

The indicator member 30 is preferably sufficiently rigid to extend directly from the bottom of the follower 24 through the indicator apertures 15*a* and 16*a*. However, the indicator member 30 should be resilient enough that it will not present an impediment to use of the gun. As used herein, "flexible" shall mean sufficiently rigid yet sufficiently resilient, as indicated above. The indicator member 30 can be made from a single material, preferably plastic.

Figure 3:
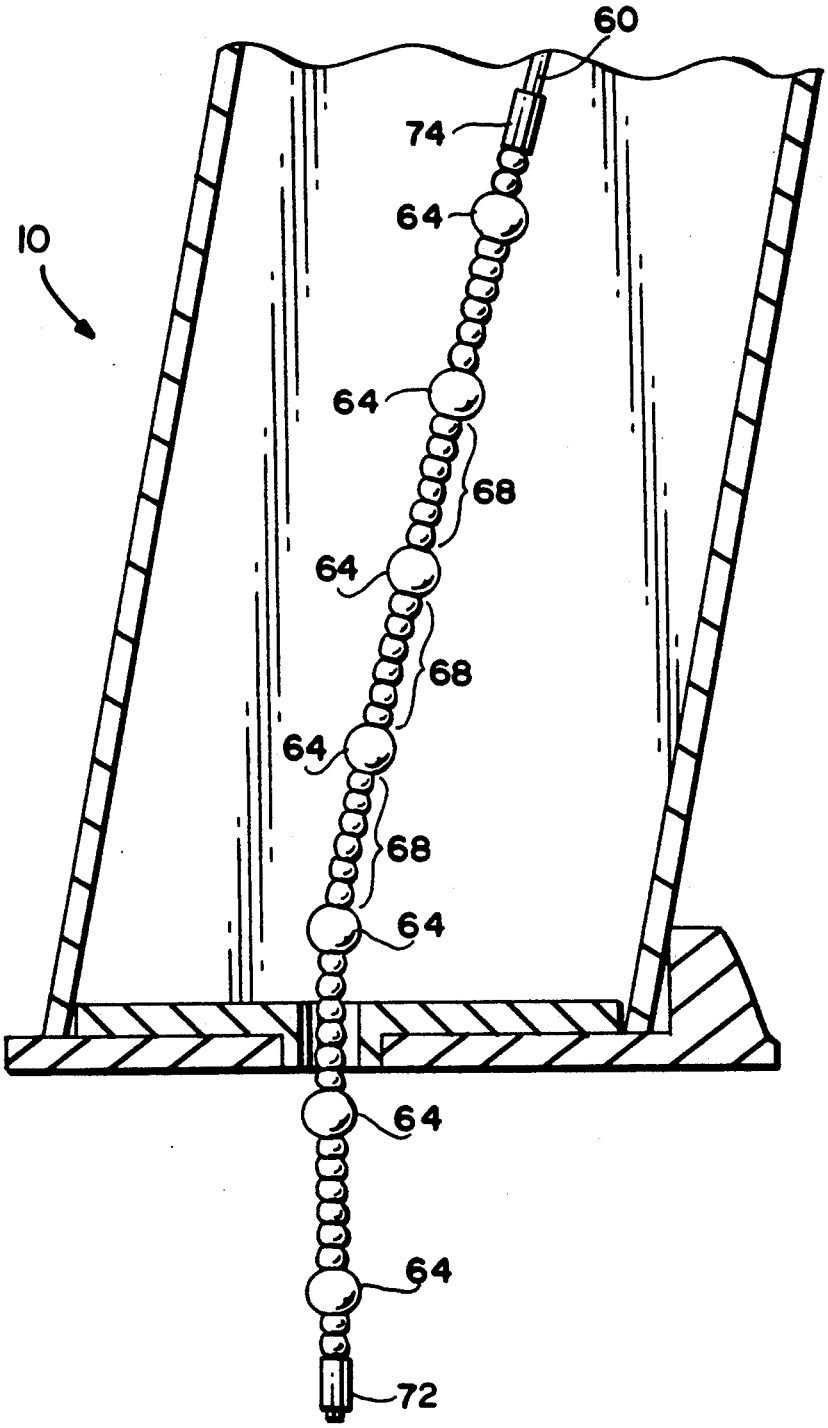
FIG. 3 is a side cut away view of another preferred embodiment of the indicator member.

Referring to FIG. 3, shown is another preferred embodiment of an indicator according to this invention, with the magazine 10 cut away for clarity. This alternative embodiment comprises a strand 60, preferably of braided steel, that is attached to the follower (not shown), with indicator beads 64 spaced along its length at appropriate intervals by spacer beads 68. The indicator beads 64 and spacer beads 68 are retained on the strand by a lower retaining member 72 and an upper retaining member 74. The indicator beads 64 and spacer beads 68 can be made from various materials, such as plastics, metals, woods or ceramics, as can the retaining members 72 and 74.

Figure 5:
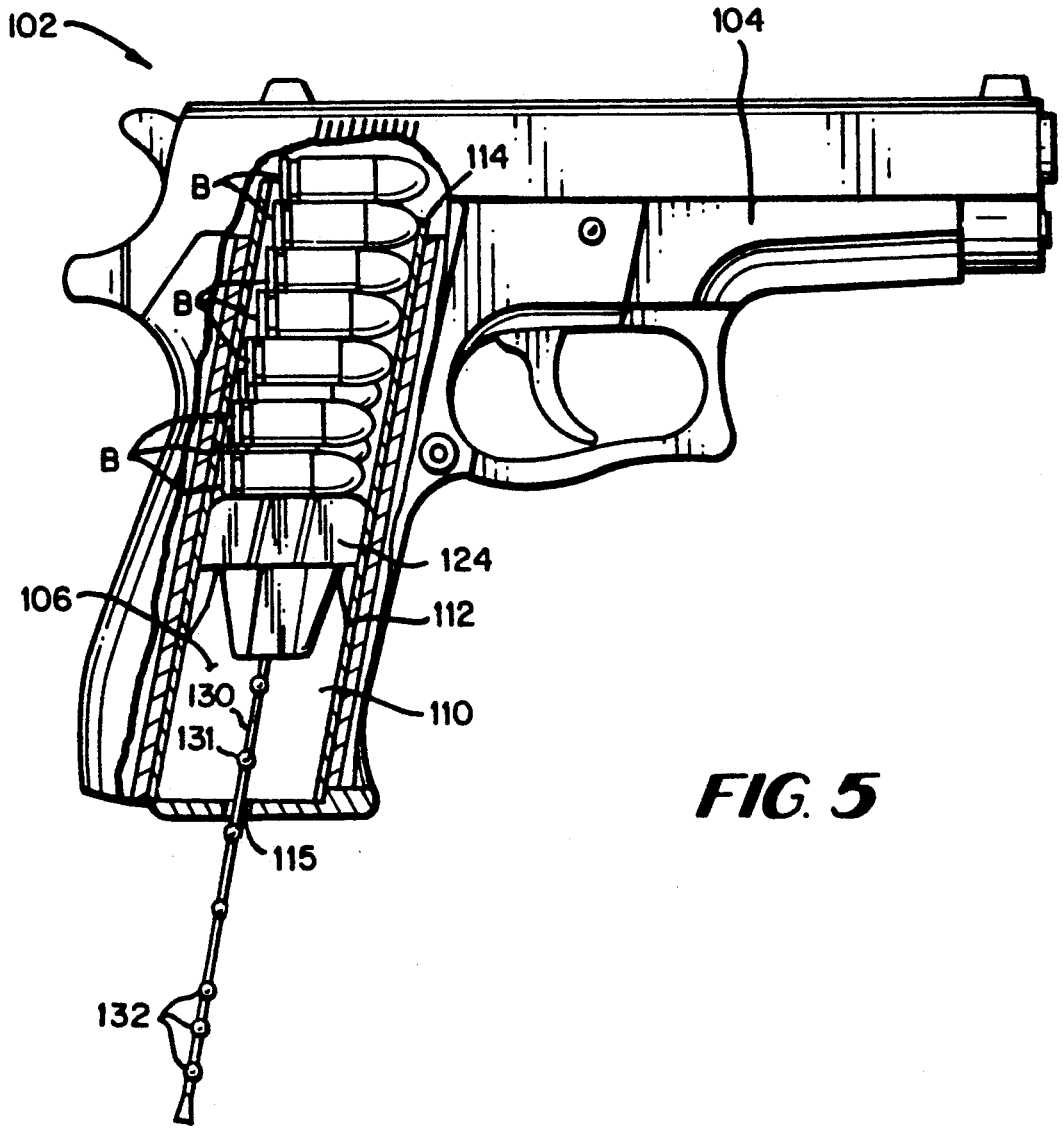
FIG. 5 is a side elevational cut away view of a gun according to this invention having the indicator member of FIG. 4 extending from the indicator aperture indicating that there are several bullets remaining in the magazine.

Referring to FIG. 5, shown is a side elevational cut away view of a gun 102 according to the present invention. The gun 102 has a gun body 104 with a magazine aperture for a magazine 110. The magazine has a hollow body 112 with a bullet aperture 114 through which bullets B are loaded into the hollow body 112, and also has an indicator aperture 115. A follower 124 is slidably mounted in the hollow body 112, and an indicator member 130 having a plurality of knows 131, 132 is attached to the bottom of the follower 124 and extends through the indicator aperture 115. Because a number of bullets B remain in the magazine 110, a number of knots 131, 132 remain projecting outside the magazine 110 indicating that fact. The specific number and configuration of knots 131, 132 corresponding to a specific number of bullets B remaining is preferably determined by making each of certain knots 131 on a first part correspond to first predetermined numbers of bullets (such as three or fives) remaining, with each of the remaining knots 132 on a second part corresponding to second predetermined numbers of bullets (such as ones) remaining.

It is clear from the foregoing that it would be a very easy matter to retrofit existing magazines to practice this invention merely by attaching an indicator member to the follower and drilling a hole through the internal floor insert and base plate (if they are not already provided with a suitable aperture) to allow the indicator member to project out the bottom of the magazine.

It is also clear that existing guns can easily be provided with this indicator merely by providing replacement magazines equipped with the indicator because the indicator is self contained in the magazine and does not require any cooperating structure in the gun itself.

Of course, this invention can be employed in guns that do not have removable magazines but into which bullets are loaded directly, as long as there is a follower that urges the bullets into the firing chamber and an indicator aperture for the indicator member.

The invention has been described with respect to a particular preferred embodiment. It will be obvious to those skilled in the art that changes and modifications can be made to the embodiment described above without departing from the scope and spirit of the invention. Accordingly, no limitations are to be implied or inferred in the scope of the invention except as specifically set forth in the attached claims.

What is claimed is:

1. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a plurality of knots spaced at predetermined intervals;

wherein said intervals are determined by the displacement of said follower caused by the ejection of first predetermined numbers of bullets from said hollow body and then by the ejection of second predetermined numbers of bullets from said hollow body;

whereby each knot on a first part of said indicator member corresponds to a first predetermined number of bullets remaining in said magazine and each knot on a second part of said indicator member corresponds to a second predetermined number of bullets remaining in said magazine, wherein said first predetermined number is a first constant whole number and said second predetermined number is a second constant whole number;

whereby the number of said knots projecting outside said body indicates the number of bullets remaining said body.

2. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a strand having a plurality of beads attached at predetermined intervals;

wherein said intervals are determined by the displacement of said follower caused by the ejection of first predetermined numbers of bullets from said hollow body and then by the ejection of second predetermined numbers of bullets from said hollow body;

whereby each bead on a first part of said strand corresponds to a first predetermined number of bullets remaining in said magazine and each bead on a second part of said strand corresponds to a second predetermined number of bullets remaining in said magazine, wherein said first predetermined number is a first constant whole number and said second predetermined number is a second constant whole number;

whereby the number of said beads projecting outside said body indicates the number of bullets remaining in said body.

3. A magazine according to claim 2, wherein said strand comprises braided steel and said beads comprise a material selected from the group consisting of plastics, metals, woods and ceramics.

4. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a plurality of knots spaced at predetermined intervals; and wherein said magazine has a capacity for a number of bullets and said plurality is equal to said number.

5. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a plurality of knots spaced at predetermined intervals; and wherein said predetermine intervals are fixed so that when a number of bullets is inserted in said magazine, an equal number of said knots projects outside said indicator aperture, whereby said number of said knots projecting outside said aperture equals said number of bullets remaining in said magazine.

6. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a strand having a plurality of beads attached at predetermined intervals; and wherein said predetermined intervals are fixed so that when a number of bullets is inserted in said magazine, an equal number of said beads projects outside said indicator aperture, whereby said number of said beads projecting outside said aperture equals said number of bullets remaining in said magazine.

7. A magazine, comprising:

an elongated hollow body having a bullet aperture at a top end and an indicator aperture at a bottom end;

a follower slidably mounted in said hollow body;

a spring for urging said follower towards said bullet aperture;

a strand attached to said follower, extending through said indicator aperture, and projecting outside said body by an indicator length;

a plurality of knots spaced at predetermined intervals along said strand, wherein said predetermined intervals are fixed so that when a number of bullets is inserted into said hollow body through said bullet aperture, an equal number of said knots projects outside said indicator aperture, whereby said number of said knots projecting outside said aperture equals said number of bullets in said magazine.

8. An indicator for a magazine having a follower and a strand aperture, comprising:

a strand of flexible material having a plurality of knots spaced at predetermined intervals, wherein said predetermined intervals are fixed so that when said strand is attached to said follower and extends through said strand aperture and a number of bullets is inserted in said magazine, an equal number of knots projects outside said strand aperture.

9. An indicator according to claim 8, wherein said strand comprises plastic.

10. An indicator for a magazine having a follower and a strand aperture, comprising:

a strand of flexible material having a plurality of beads spaced at predetermined intervals, wherein said predetermined intervals are fixed so that when said strand is attached to said follower and extends through said strand aperture and a number of bullets is inserted in said magazine, an equal number of beads projects outside said strand aperture.

11. An indicator according to claim 10, wherein said strand comprises stainless steel.

12. An indicator according to claim 10, wherein said beads comprise a material selected from the group consisting of plastics, metals, woods and ceramics.

13. A process for indicating the number of bullets in a magazine having a follower and an aperture, comprising:

attaching a strand of flexible material to said follower; and inserting said strand through said aperture;

whereby said strand extends outside said magazine by an indicator length and whereby displacement of said follower causes a change in said indicator length;

wherein said strand comprises a plurality of knots spaced at predetermined intervals along said strand, wherein said predetermined intervals are fixed so that when a number of bullets is inserted into said magazine, an equal number of knots projects outside said aperture, whereby said number of knots projecting outside said aperture equals said number of bullets in said magazine.

14. A process for indicating the number of bullets in a magazine having a follower and an aperture, comprising:

attaching a strand of flexible material to said follower; and inserting said strand through said aperture;

whereby said strand extends outside said magazine by an indicator length and whereby displacement of said follower causes a change in said indicator length;

wherein said strand is provided with a plurality of beads spaced at predetermined intervals along said strand, wherein said predetermined intervals are fixed so that when a number of bullets is inserted into said magazine, an equal number of said beads projects outside said aperture, whereby said number of beads projecting outside said aperture equals said number of bullets in said magazine.

15. A gun, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a plurality of knots spaced at predetermined intervals; and wherein said intervals are determined by the displacement of said follower caused by the ejection of first predetermined numbers of bullets from said hollow body and then by the ejection of said predetermined numbers of bullets from said hollow body;

whereby each knot on a first part of said indicator member corresponds to a first predetermined number of bullets remaining in said magazine and each knot on a second part of said indicator member corresponds to a second predetermined number of bullets remaining in said magazine, wherein said first predetermined number is a first constant whole number and said second predetermined number is a second constant whole number;

whereby the number of said knots projecting outside said hollow body indicates the number of bullets remaining in said hollow body.

16. A gun, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a strand having a plurality of beads attached at predetermined intervals; and wherein said intervals are determined by the displacement of said follower caused by the ejection of first predetermined numbers of bullets from said hollow body and then by the ejection of said predetermined numbers of bullets from said hollow body;

whereby each bead on a first part of said strand corresponds to a first predetermined number of bullets remaining in said magazine and each bead on a second part of said strand corresponds to a second predetermined number of bullets remaining in said magazine, wherein said first predetermined number is a first constant whole number and said second predetermined number is a second constant whole number;

whereby the number of said knots projecting outside said hollow body indicates the number of bullets remaining in said hollow body.

17. A gun according to claim 16, wherein said strand comprises braided steel and said beads comprise a material selected from the group consisting of plastics, metals, woods and ceramics.

18. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a plurality of knots spaced at predetermined intervals;

wherein said magazine has a capacity for a number of bullets and said plurality if equal to said number.

19. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a plurality of knots spaced at predetermined intervals;

wherein said predetermined intervals are fixed so that when a number of bullets is inserted in said magazine, an equal number of said knots projects outside said indicator aperture, whereby said number of said knots projecting outside said aperture equals said number of bullets remaining in said magazine.

20. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a strand having a plurality of beads attached at predetermined intervals;

wherein said intervals are fixed so that when a number of bullets is inserted in said magazine, an equal number of said beads projects outside said indicator aperture, whereby said number of said beads projecting outside said aperture equals said number of bullets remaining in said magazine.

21. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a plurality of knots spaced at predetermined intervals;

wherein said intervals are determined by the displacement of said follower caused by the ejection of first predetermined numbers of bullets from said hollow body, then by the ejection of said predetermined numbers of bullets from said hollow body, and then by the ejection of third predetermined numbers of bullets form said hollow body;

whereby each knot on a first part of said indicator member corresponds to a first predetermined number of bullets remaining in said magazine, each knot on a second part of said indicator member corresponds to a second predetermined number of bullets remaining in said magazine, and each knot on a third part of said indicator member corresponds to a third predetermined number of bullets remaining in said magazine, wherein said first predetermined number is a first constant whole number, said second predetermined number is a second constant whole number, and said third predetermined number is a third constant whole number.

whereby the number of said knots projecting outside said body indicates the number of bullets remaining in said body.

22. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a first plurality of knots spaced at predetermined intervals, wherein said knots have a second plurality of different configurations and said configurations provide a tactile code of how many bullets remain in said magazine.

23. A magazine according to claim 22, wherein said configurations are selected so that a user can determine how many bullets remain in said magazine by feeling only the knot closest to said indicator aperture.

24. An indicator for a magazine having a follower and a strand aperture, comprising:

a strand of flexible material having a first plurality of knots spaced at predetermined intervals, wherein said knots have a second plurality of different configurations and said configurations provide a tactile code of how many bullets remain in said magazine.

25. An indicator according to claim 24, wherein said configurations are selected so that a user can determine how many bullets remain in said magazine by feeling the knot closest to said strand aperture.

26. A process for indicating the number of bullets in a magazine having a follower and an aperture, comprising:

attaching a strand of flexible material to said follower; and inserting said strand through said aperture;

whereby said strand extends outside said magazine by an indicator length and whereby displacement of said follower causes a change in said indicator length;

wherein said strand comprises a plurality of knots spaced at predetermined intervals;

wherein said intervals are determined by the displacement of said follower caused by the ejection of first predetermined numbers of bullets from said magazine and then by the ejection of second predetermined numbers of bullets from said magazine;

whereby each knot on a first part of said strand corresponds to a first predetermined number of bullets remaining in said magazine and each knot on a second part of said strand corresponds to a second predetermined number of bullets remaining in said magazine, wherein said first predetermined number is a first constant whole number and said second predetermined number is a second constant whole number;

whereby the number of said knots projecting outside said magazine indicates the number of bullets remaining in said magazine.

27. A process for indicating the number of bullets in a magazine having a follower and an aperture, comprising:

attaching a strand of flexible material to said follower; and inserting said strand through said aperture;

whereby said stand extends outside said magazine by an indicator length and whereby displacement of said follower causes a change in said indicator length;

wherein said strand comprises a first plurality of knots spaced at predetermined intervals, wherein said knots have a second plurality of different configurations and said configurations provide a tactile code of how many bullets remain in said magazine.

28. A processing according to claim 27, wherein said configurations are selected so that a user can determined how many bullets remain in said magazine by feeling the knot closest to said aperture.

29. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a plurality of knots spaced at predetermined intervals;

wherein said intervals are determined by the displacement of said follower caused by the ejection of first predetermined numbers of bullets form said hollow body, then by the ejection of second predetermined numbers of bullets from said hollow body, and then by the ejection of third predetermined numbers of bullets from said hollow body;

whereby each knot on a first part of said indicator member corresponds to a first predetermined number of bullets remaining in said magazine, each knot on a second part of said indicator member corresponds to a second predetermined number of bullets remaining in said magazine, and each knot on a third part of said indicator member corresponds to a third predetermined number of bullets remaining in said magazine, wherein said first predetermined number is a first constant whole number, said second predetermined number is a second constant whole number, and said third predetermined number is a third constant whole number;

whereby the number of said knots projecting outside said body indicates the number of bullets remaining in said body.

30. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a first plurality of knots spaced at predetermined intervals, wherein said knots have a second plurality of different configurations and said configurations provide a tactile code of how many bullets remain in said magazine.

31. A gun according to claim 30, wherein said configurations are selected so that a user can determine how many bullets remain in said magazine by feeling the knot closest to said indicator aperture.

32. A process for using a strand of flexible material, comprising:

attaching said strand to a follower in a magazine having an indicator aperture; and inserting said strand through said aperture;

whereby said strand extends outside said magazine by an indicator length and whereby displacement of said follower causes a change in said indicator length;

wherein said attaching step is performed using a strand having a plurality of knots spaced at predetermined intervals;

wherein said intervals are determined by the displacement of said follower caused by the ejection of first predetermined numbers of bullets from said magazine and then by the ejection of second predetermined numbers of bullets from said magazine;

whereby each knot on a first part of said strand corresponds to a first predetermined number of bullets remaining in said magazine and each knot on a second part of said strand corresponds to a second predetermined number of bullets remaining in said magazine, wherein said first predetermined number is a first constant whole number and said second predetermined number is a second constant whole number;

whereby the number of said knots extending through said aperture indicates the number of bullets remaining in said magazine.

33. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a strand having a plurality of beads attached at predetermined intervals;

wherein said magazine has a capacity for a number of bullets and said plurality is equal to said number.

34. A process for indicating the number of bullets in a magazine having a follower, comprising:

forming an indicator aperture in said magazine;

attaching a strand of flexible material to said follower; and inserting said strand through said indicator aperture;

whereby said strand extends outside said magazine by an indicator length and whereby displacement of said follower causes a change in said indicator length;

wherein said strand comprises a plurality of knots spaced at predetermined intervals along said strand, wherein said predetermined intervals are fixed so that when a number of bullets is inserted into said magazine, an equal number of knots projects outside said aperture, whereby said number of knots projecting outside said aperture equals said number of bullets in said magazine.

35. A process for indicating the number of bullets in a magazine having a follower, comprising:

forming an indicator aperture in said magazine;

attaching a strand of flexible material to said follower; and inserting said strand through said indicator aperture;

whereby said strand extends outside said magazine by an indicator length and whereby displacement of said follower causes a change in said indicator length;

wherein said strand is provided with a plurality of beads spaced at predetermined intervals along said strand, wherein said predetermined intervals are fixed so that when a number of bullets is inserted into said magazine, an equal number of said beads projects outside said aperture, whereby said number of beads projecting outside said aperture equals said number of bullets in said magazine.

36. A gun having an indicator, comprising:

a gun body having a magazine aperture for a magazine;

a magazine having a hollow body, a bullet aperture and an indicator aperture;

a follower slidably mounted in said hollow body; and an elongated indicator member attached to said follower, extending through said indicator aperture, and projecting outside said magazine by an indicator length;

whereby displacement of said follower causes a change in said indicator length;

wherein said indicator member comprises a strand having a plurality of beads attached at predetermined intervals;

wherein said magazine has a capacity for a number of bullets and said plurality is equal to said number.

37. A process for indicating the number of bullets in a magazine having a follower, comprising:

forming an indicator aperture in said magazine;

attaching a strand of flexible material to said follower; and inserting said strand through said indicator aperture;

whereby said strand extends outside said magazine by an indicator length and whereby displacement of said follower causes a change in said indicator length;

wherein said strand comprises a plurality of knots spaced at predetermined intervals;

wherein said intervals are determined by the displacement of said follower causes by the ejection of first predetermined numbers of bullets from said magazine and then by the ejection of second predetermined numbers of bullets from said magazine;

whereby each knot on a first part of said stand corresponds to a first predetermined number of bullets remaining in said magazine and each knot on a second part of said strand corresponds to a second predetermined number of bullets remaining in said magazine, wherein said first predetermined number is a first constant whole number and said second predetermined number is a second constant whole number;

whereby the number of said knots projecting outside said magazine indicates the number of bullets remaining in said magazine.

38. A process for indicating the number of bullets in a magazine having a follower, comprising:

forming an indicator aperture in said magazine;

attaching a strand of flexible material to said follower; and inserting said strand through said indicator aperture;

whereby said strand extends outside said magazine by an indicator length and whereby displacement of said follower causes a change in said indicator length;

wherein said strand comprises a first plurality of knots spaced at predetermined intervals, wherein said knots have a second plurality of different configurations and said configurations provide a tactile code of how many bullets remain in said magazine.

39. A magazine according to claim 1, 2 or 21, wherein said first constant whole number is one and said second constant whole number is greater than one.

40. A gun according to claim 15, 16 or 29, wherein said first constant whole number is one and said second constant whole number is greater than one.

41. A process according to claim 26, 32 or 37, wherein said first constant whole number is one and said second constant whole number is greater than one.

42. A magazine, comprising:

a hollow body having a bullet aperture and an indicator aperture;

a follower slidably mounted in said hollow body; and an elongated indicator member attached to said follower, extending through said indicator aperture, and projecting outside said body by an indicator length;

whereby displacement of said follower causes a change in said indicator length;

wherein said indicator member comprises a plurality of knots spaced at predetermined intervals;

wherein one of said knots indicates that only one bullet remains in said magazine.

43. A gun having an indicator, comprising:

a gun body having a follower that urges bullets into a firing chamber and an indicator aperture;

an elongated indicator member attached to said follower, extending through said indicator aperture, and projecting outside said gun body by an indicator length;

whereby displacement of said follower causes a change in said indicator length;

wherein said indicator member comprises a plurality of knots spaced at predetermined intervals; and wherein said intervals are determined by the displacement of said follower caused by the ejection of first predetermined numbers of bullets into said firing chamber and then by the ejection of second predetermined numbers of bullets into said firing chamber;

whereby each knot on a first part of said indicator member corresponds to a first predetermined number of bullets remaining in said gun body and each knot on a second part of said indicator member corresponds to a second predetermined number of bullets remaining in said gun body, wherein said first predetermined number is a first constant whole number and said second predetermined number is a second constant whole number;

whereby the number of said knots projecting outside said gun body indicates the number of bullets remaining in said gun body.

44. A gun having an indicator, comprising:

a gun body having a follower that urges bullets into a firing chamber and an indicator aperture;

an elongated indicator member attached to said follower, extending through said indicator aperture, and projecting outside said gun body by an indicator length;

whereby displacement of said follower causes a change in said indicator length;

wherein said indicator member comprises a plurality of knots spaced at predetermined intervals; and wherein said gun body has a capacity for a number of bullets and said plurality is equal to said number.

45. A gun having an indicator, comprising:

a gun body having a follower that urges bullets into a firing chamber and an indicator aperture;

an elongated indicator member attached to said follower, extending through said indicator aperture, and projecting outside said gun body by an indicator length;

whereby displacement of said follower causes a change in said indicator length;

wherein said indicator member comprises a plurality of knots spaced at predetermined intervals;

wherein said predetermined intervals are fixed so that when a number of bullets is inserted in said gun body, an equal number of said knots projects outside said indicator aperture, whereby said number of said knots projecting outside said aperture equals said number of bullets remaining in said gun body.

46. A gun having an indicator, comprising:

a gun body having a follower that urges bullets into a firing chamber and an indicator aperture;

an elongated indicator member attached to said follower, extending through said indicator aperture, and projecting outside said gun body by an indicator length;

whereby displacement of said follower causes a change in said indicator length;

wherein said indicator member comprises a first plurality of knots spaced at predetermined intervals, wherein said knots have a second plurality of different configurations and said configurations provide a tactile code of how many bullets remain in said gun body.

47. An indicator for a magazine having a follower and a strand aperture, comprising:

a stand of flexible material having a plurality of knots spaced at predetermined intervals;

wherein said intervals are determined by the displacement of said follower caused by the ejection of first predetermined numbers of bullets from said magazine and then by the ejection of second predetermined numbers of bullets from said magazine;

whereby each knot on a first part of said strand corresponds to a first predetermined number of bullets remaining in said magazine and each knot on a second part of said strand corresponds to a second predetermined number of bullets remaining in said magazine, wherein said first predetermined number is a first constant whole number and said second predetermined number is a second constant whole number;

whereby the number of said knots projecting outside said magazine indicates the number of bullets remaining in said magazine.

48. A strand according to claim 47, wherein said first constant whole number is one and said second constant whole number is greater than one.

* * * * *